US009822614B2

(12) United States Patent
Costa et al.

(10) Patent No.: US 9,822,614 B2
(45) Date of Patent: Nov. 21, 2017

(54) COMBINED CASING SYSTEM AND METHOD

(71) Applicant: Shell Oil Company, Houston, TX (US)

(72) Inventors: Darrell Scott Costa, Katy, TX (US); William Robert Portas, Jr., Gautier, MS (US); Djurre Hans Zijsling, Rijswijk (NL)

(73) Assignee: SHELL OIL COMPANY, Houston, TX (US)

( * ) Notice: Subject to any disclaimer, the term of this patent is extended or adjusted under 35 U.S.C. 154(b) by 857 days.

(21) Appl. No.: 14/353,735

(22) PCT Filed: Oct. 23, 2012

(86) PCT No.: PCT/EP2012/070926
§ 371 (c)(1),
(2) Date: Apr. 23, 2014

(87) PCT Pub. No.: WO2013/060660
PCT Pub. Date: May 2, 2013

(65) Prior Publication Data

US 2015/0047857 A1 Feb. 19, 2015

(30) Foreign Application Priority Data

Oct. 25, 2011 (EP) ..... 11186517

(51) Int. Cl.
*E21B 43/10* (2006.01)
*E21B 7/20* (2006.01)

(52) U.S. Cl.
CPC ..... *E21B 43/10* (2013.01); *E21B 7/20* (2013.01); *E21B 43/103* (2013.01)

(58) Field of Classification Search
CPC ..... E21B 43/10; E21B 7/20; E21B 43/103
USPC ..... 166/381, 242.1
See application file for complete search history.

(56) References Cited

U.S. PATENT DOCUMENTS 5,337,823 A * 8/1994 Nobileau ..... B29C 63/343 166/277
7,025,580 B2 * 4/2006 Heagy ..... B29C 63/34 138/108
7,152,673 B2 * 12/2006 Lohbeck ..... E21B 43/103 138/118.1

(Continued)

FOREIGN PATENT DOCUMENTS

WO 1999035368 A1 7/1999
WO 2006012186 A1 2/2006

OTHER PUBLICATIONS

PCT International Search Report, Application No. PCT/EP2012/070926 dated Nov. 23, 2012.

(Continued)

*Primary Examiner* — Michael R Wills, III

(57) ABSTRACT

The invention relates to a method for drilling and casing a wellbore using a drilling rig having a predetermined load capacity, using a casing scheme comprising two or more casing strings, and at least one combined casing string, which includes a first one of the casing strings fitting within a second casing string. The weight of the at least one combined casing string may exceed the load capacity of the drilling rig, and the weight of each of the parts of the at least one combined casing string is less than the load capacity.

22 Claims, 14 Drawing Sheets

(56) References Cited

U.S. PATENT DOCUMENTS

| | | | | |
|---|---|---|---|---|
| 7,178,601 | B2 * | 2/2007 | Burge | E21B 43/103 166/207 |
| 2001/0020532 | A1 | 9/2001 | Baugh et al. | |
| 2006/0243452 | A1 | 11/2006 | Eckerlin | |
| 2008/0087423 | A1 | 4/2008 | Wylie et al. | |
| 2008/0110616 | A1 * | 5/2008 | Nobileau | E21B 43/103 166/207 |
| 2009/0288842 | A1 | 11/2009 | Kriesels | |
| 2010/0038076 | A1 | 2/2010 | Spray et al. | |
| 2010/0331959 | A1 | 12/2010 | Kriesels et al. | |

OTHER PUBLICATIONS

"A Method of Obtaining Leakproof API Threaded Connections in High-pressure Gas Service" by P. D. Weiner et al., 1969, American Petroleum Institute [SPE document ID 69-040].

* cited by examiner

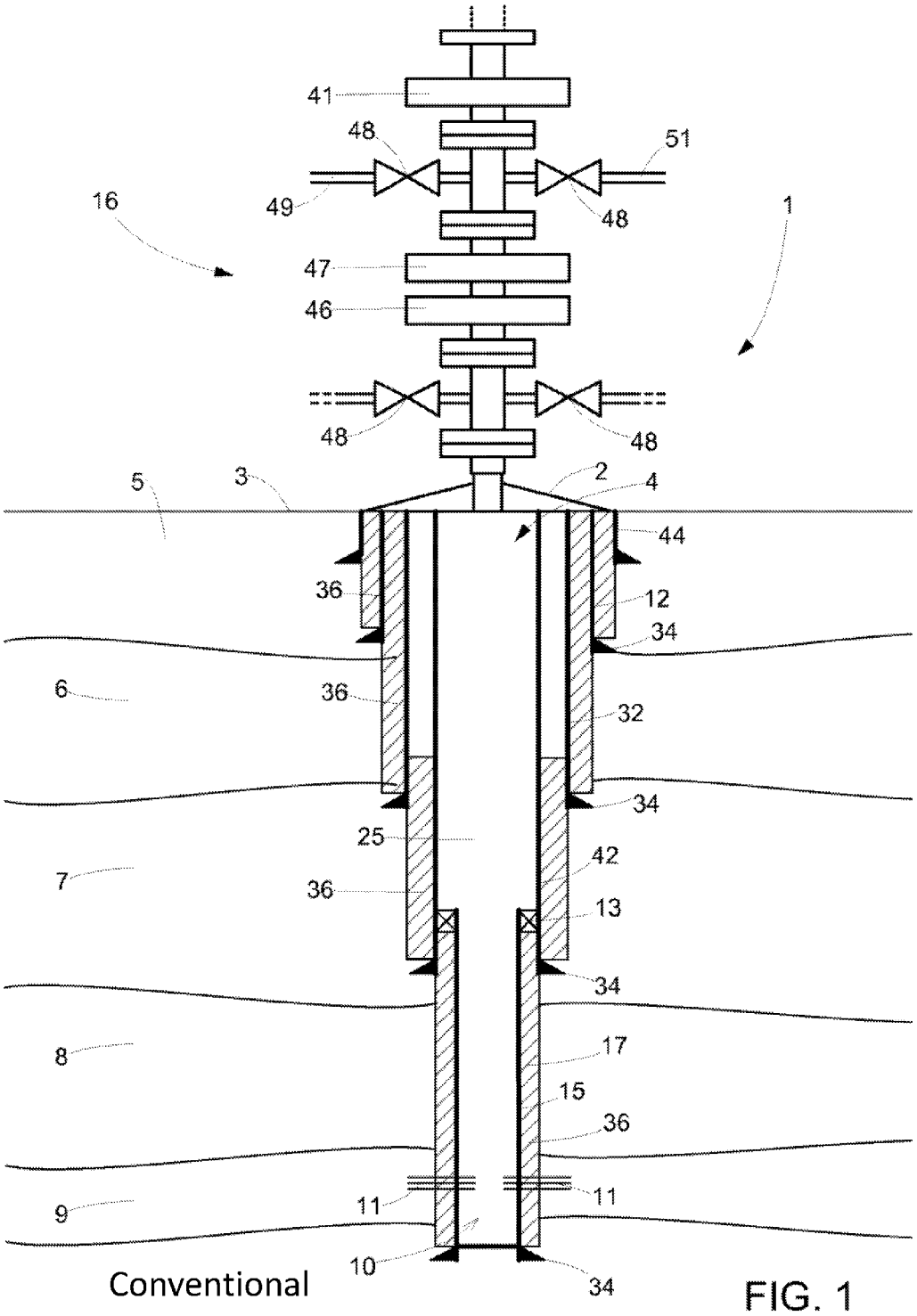
Conventional
FIG. 1

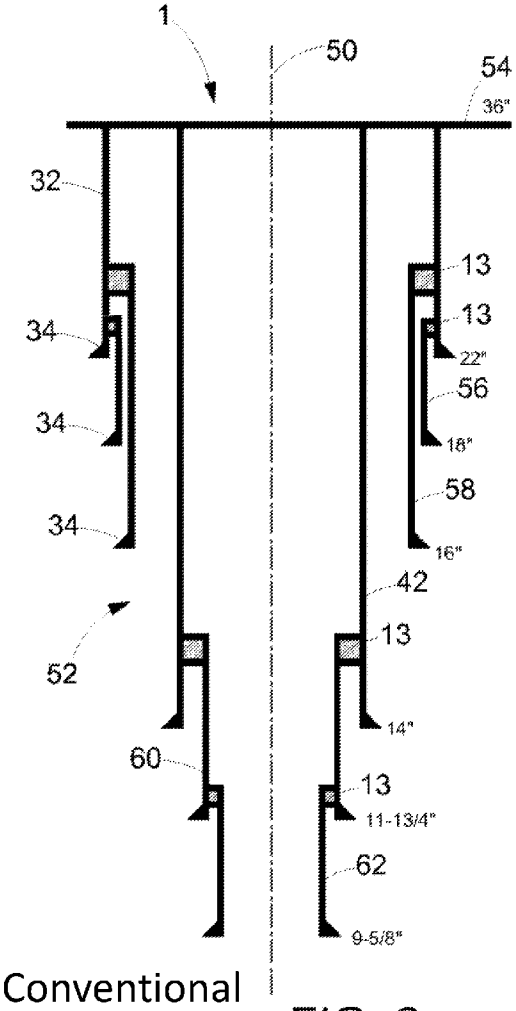
FIG. 2
Conventional

FIG. 5 B
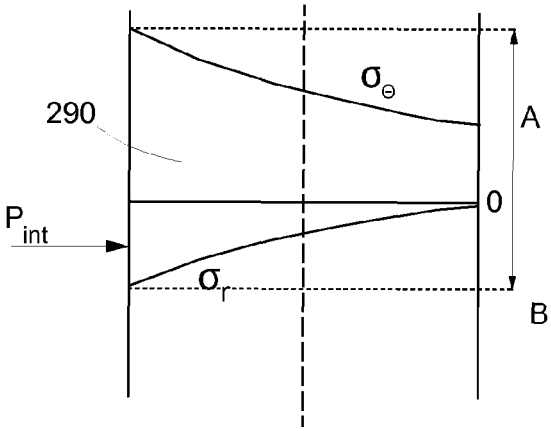
FIG. 5 C
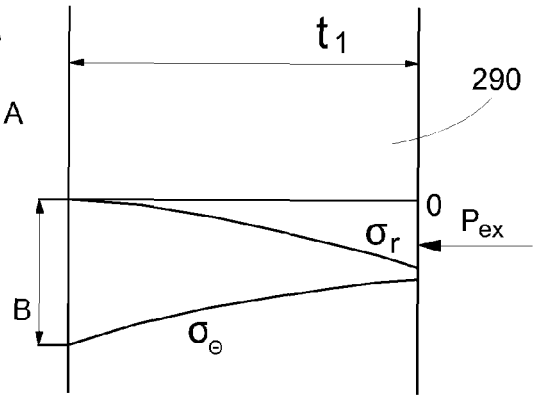
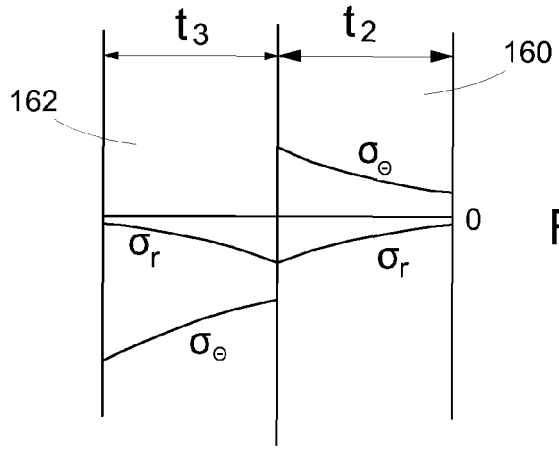
FIG. 5 D
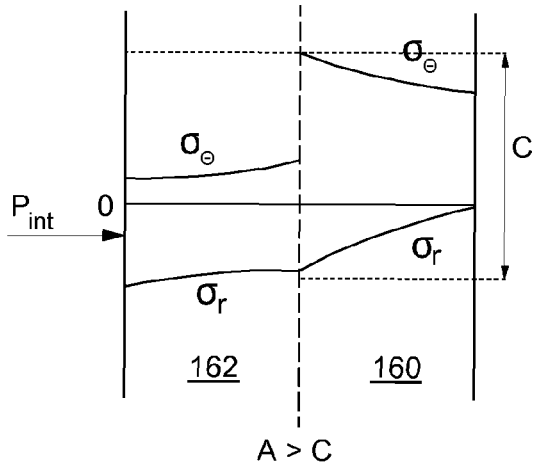
FIG. 5E
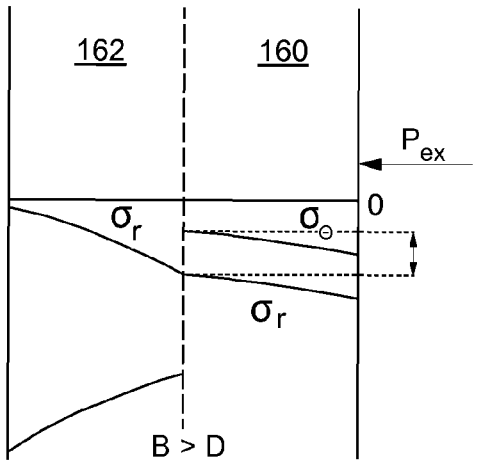
FIG. 5F

| string no | OD | t | exp ratio | exp force | exp pressure | ID | t | OD | Sig-y | P-y | P-c | Cum burst | P-y (tw) |
|---|---|---|---|---|---|---|---|---|---|---|---|---|---|
| | (") | (") | (%) | (kips) | (psi) | (") | (") | (") | (ksi) | (psi) | (psi) | (psi) | (psi) |
| 1 | 11.750 | 0.375 | 11.4 | 128.1 | 1330 | 12.25 | 0.349 | 12.948 | 69.2 | 3945 | 965 | 16616 | 15519 |
| 2 | 11.750 | 0.375 | 17.7 | 206.9 | 2111 | 12.948 | 0.336 | 13.620 | 73.6 | 3824 | 741 | 12671 | 11834 |
| 3 | 13.375 | 0.48 | 9.7 | 156.1 | 1278 | 13.620 | 0.451 | 14.522 | 67.8 | 4491 | 1376 | 8847 | 8403 |
| 4 | 13.375 | 0.48 | 17.0 | 285.5 | 2292 | 14.522 | 0.432 | 15.387 | 73.2 | 4357 | 1077 | 4357 | 3999 |

FIG. 10 A

| string no | weight | OD | t | running cl | exp ratio | ID | t | OD |
|---|---|---|---|---|---|---|---|---|
| | (#/ft) | (") | (") | (") | (%) | (") | (") | (") |
| 1 | 29,7 | 7,625 | 0,375 | 1,526 | 23,6 | 8,5 | 0,325 | 9,151 |
| 1 | 31,5 | 8,000 | 0,375 | 1,792 | 26,2 | 9,151 | 0,321 | 9,792 |
| 2 | 36 | 9,625 | 0,352 | 0,829 | 9,8 | 9,792 | 0,331 | 10,454 |
| 3 | 36 | 9,625 | 0,352 | 1,462 | 17,2 | 10,454 | 0,317 | 11,087 |
| 4 | 36 | 9,625 | 0,352 | 2,070 | 24,3 | 11,087 | 0,304 | 11,695 |
| 5 | 60 | 11,75 | 0,489 | 0,871 | 8,6 | 11,695 | 0,463 | 12,621 |
| 6 | 60 | 11,75 | 0,489 | 1,750 | 17,2 | 12,621 | 0,440 | 13,500 |
| 7 | 60 | 11,75 | 0,489 | 2,591 | 25,3 | 13,500 | 0,420 | 14,341 |
| 8 | 68 | 13,375 | 0,48 | 1,838 | 15,5 | 14,311 | 0,436 | 15,213 |
| 9 | 68 | 13,375 | 0,48 | 2,675 | 22,5 | 15,213 | 0,419 | 16,050 |
| 10 | 84 | 16 | 0,495 | 0,997 | 6,9 | 16,050 | 0,473 | 16,997 |
| 11 | 84 | 16 | 0,495 | 1,908 | 13,2 | 16,997 | 0,455 | 17,908 |
| 12 | 84 | 16 | 0,495 | 2,787 | 19,3 | 17,908 | 0,440 | 18,787 |

FIG. 10 B

COMBINED CASING SYSTEM AND METHOD

CROSS-REFERENCE TO RELATED APPLICATIONS

The present application which is a 371 application of PCT/EP2012/070926, filed Oct. 23, 2012, claims priority from European Application EP 11186517.6, filed Oct. 25, 2011.

STATEMENT REGARDING FEDERALLY SPONSORED RESEARCH OR DEVELOPMENT

Not applicable.

THE NAMES OF THE PARTIES TO A JOINT RESEARCH AGREEMENT

Not applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not applicable.

STATEMENT REGARDING PRIOR DISCLOSURES BY THE INVENTOR OR A JOINT INVENTOR

Not applicable.

BACKGROUND OF THE INVENTION

Field of the Invention

The present invention relates to a combined casing system and method. The method and system of the invention can be applied for lining a wellbore, for instance for the production of hydrocarbons.

Description of Related Art

Wellbores are generally provided with one or more casings or liners to provide stability to the wellbore wall and/or to provide zonal isolation between different earth formation layers. The terms "casing" and "liner" refer to tubular elements for supporting and stabilizing the wellbore wall. Herein, a casing typically extends from surface into the wellbore and a liner extends from a downhole location further into the wellbore. In the context of the present invention, the terms "casing" and "liner" may be used interchangeably and without such intended distinction.

In conventional wellbore construction, several casings are set at different depth intervals, and in a nested arrangement. Herein, each subsequent casing is lowered through the previous casing and therefore has a smaller outer diameter than the inner diameter of the previous casing. As a result, the cross-section of the wellbore which is available for oil and gas production decreases with depth.

Each casing is designed to have a burst pressure and a collapse pressure which exceed the maximum internal or external pressure respectively which may act on the casing during drilling of a new wellbore section. The new section is an open hole section which is not (yet) cased. Such maximum pressures may arise, for instance, when control of the wellbore is lost. Drilling fluid may then be expelled from the wellbore, whereafter substantially the entire inner surface of the casing, bottom to top, may be exposed to the formation pressure of the open hole section. Alternatively, the outside surface of the casing may be exposed to the formation pressure of each wellbore section.

The problem with current well bore designs is that the combination of existing casing tubulars do not meet all downhole load conditions and/or do not leave sufficient inner diameter to allow proper utilization of the well. Also, existing casing schemes leave annular spaces between successive casing strings, which can be problematic during the life of the well, for instance causing premature failure of the wellbore. The current practice is to increase the initial casing sizes to allow for the proper inner diameter at depth. Increasing the diameter increases the costs however. The annular space between the successive casing strings is currently filled with cement and/or other materials.

In addition, due to increasing demand and decreasing supply, new wellbores tend to unlock hydrocarbon reservoirs in formations at greater depth, sometimes also below a significant water depth. New wellbores therefore may have a relatively large total depth. Total depth herein indicates the planned end of the wellbore measured by the length of pipe required to reach the bottom. For instance, wellbores have been drilled having a total depth exceeding 30,000 feet (10 km) and/or below more than 4,500 feet (1.5 km) of water. Downhole pressures may exceed 400 bar, 800 bar, or even 1000 bar (about 15,000 psi). In extreme cases, for example in the Gulf of Mexico, wellbores have been drilled to a total depth of 36,000 feet (11 km) and/or below more than 10,000 feet (3.5 km) of water. Downhole pressures may exceed 26,000 psi (1800 bar).

Some of the casings will have to extend over a substantial part of the total depth. At the same time, each casing or liner will have to be able to withstand the expected downhole pressures, either from the outside or from the inside of the pipe. Herein, the maximum collapse or burst pressure of a pipe correlates for instance to the wall thickness and to the strength of the material of the pipe. In general, increasing total length of the casing, increasing the wall thickness and/or using stronger material will increase the total weight of the respective casing or liner. Local legislation however often requires the use of strong, thick walled and hence heavy casing strings. As a result, the total weight of a respective casing string may exceed the payload of currently available drilling rigs, in particular floating rigs such as semi-submersible rigs or drill ships.

Casing or liner strings are typically comprised of a number of subsequent pipe sections, which are connected to each other by pipe connections. These connections typically include threaded connections. The increase in depth and pressure of wellbores, as described above, has increased the threat of tubing joint leaks. Each failure however may provide the operators with a significant cost increase. The industry trend toward deeper (e.g. >25,000 ft), higher-pressure (e.g. >15,000 psi) wells demands development and use of new technology to meet the increasingly severe tubular-goods requirements. Said requirements typically include leak tightness, at least demanding that the tubular goods are fluid-tight but often also gas-tight. See in this respect for instance "A Method of Obtaining Leakproof API Threaded Connections In High-pressure Gas Service" by P. D. Weiner et al., 1969, American Petroleum Institute [SPE document ID 69-040].

US-2010/0038076-A1 discloses an expandable tubular including a plurality of leaves formed from sheet material that have curved surfaces. The leaves extend around a portion or fully around the diameter of the tubular structure. Some of the adjacent leaves of the tubular are coupled together. The tubular is compressed to a smaller diameter so that it can be inserted through previously deployed tubular assemblies. Once the tubular is properly positioned, it is deployed and coupled or not coupled to a previously deployed tubular assembly.

Leak paths between the inner and outer surface however are a major disadvantage of the expandable tubular disclosed in US-2010/0038076-A1. Various embodiments are disclosed to mitigate leakage. These include deformable jackets covering the inner or outer diameter of the tubular structure, adhesive binding the leaves, weld material such as plastics which may be activated downhole by a chemical conversion reaction, or the leak paths may be made very long by placing slip planes at opposite sides of the tubular structure. None of the disclosed leak mitigating embodiments however are sufficient to provide leak tightness as required for oil and gas wellbores, especially for deep high pressure applications.

BRIEF SUMMARY OF THE INVENTION

In view of the above, there is a need for an improved casing method and system.

The invention therefore provides a casing scheme for a wellbore, comprising:

two or more nested casing strings;

wherein at least one of the nested casing strings is a combined casing string, comprising at least a first casing string layer fitting within and engaging the inner surface of a second casing string layer.

In an embodiment the casing scheme comprises two or more combined casing strings in a nested arrangement. Herein, each combined casing string comprises at least two casing string layers, wherein one layer fits within and engages the inner surface of another casing string layer. One combined casing string layer is arranged with a second combined casing string layer.

In an embodiment, each casing string layer is a substantially closed tubular element. Closed herein implies that the tubular element is a pipe having a continuous cylindrical wall. Said wall lacks openings such as holes or slots. The closed tubular element is preferably fluid-tight. Optionally, the closed tubular element is gas-tight.

In another embodiment, the casing scheme comprises:

a tubular conductor;

a surface casing string which is arranged within the conductor with an annular space therebetween; and a production casing string, which is arranged within the surface casing string with an annular space therebetween, wherein the production casing string is a first combined casing string.

The first combined casing string may extend from the wellhead to a first downhole location, and a second combined casing string may extend from a second downhole location to a third downhole location. The at least one combined casing string may comprise at least a third casing string layer. Optionally, the third casing string layer may fit within and engage the inner surface of at least a fourth casing string layer.

In another embodiment, a gap between the first casing string layer and the second casing string layer is smaller than a critical gap size.

According to another aspect, the invention provides a method for casing a wellbore, comprising the steps of:

providing two or more nested casing strings;

wherein at least one of the nested casing strings is a combined casing string, comprising at least a first casing string layer fitting within and engaging the inner surface of a second casing string layer.

In an embodiment, at least two or more of the nested casing strings are combined casing strings in a nested arrangement. A gap between the first casing string layer and the second casing string layer may be smaller than a critical gap size.

According to still another aspect, the invention provides a method of drilling and casing a wellbore using a drilling rig having a predetermined load capacity, comprising the step of:

using the casing scheme or the method as disclosed above, wherein the weight of the at least one combined casing string exceeds the load capacity of the drilling rig, and wherein the weight of each of the casing string layers of said combined casing string is less than the load capacity.

BRIEF DESCRIPTION OF THE DRAWINGS

The invention will be described hereinafter in more detail and by way of example, with reference to the accompanying drawings, wherein:

FIG. 1 shows a cross-section of a wellbore including a conventional casing scheme;

FIG. 2 shows a cross-section of another conventional casing scheme;

FIGS. 5B and 5C show a cross section of the wall of a pipe wherein internal or external pressure is applied respectively, wherein radial stress and circumferential stress are diagrammatically indicated;

FIGS. 5D to 5F show a cross section of a double-walled pipe according to the invention, wherein radial stress and circumferential stress are diagrammatically indicated;

FIGS. 10A and 10B show a diagram including parameters of a casing scheme according to the method of the invention.

In the Figures and the description like reference numerals relate to like components.

DETAILED DESCRIPTION OF THE INVENTION

Figure 4:
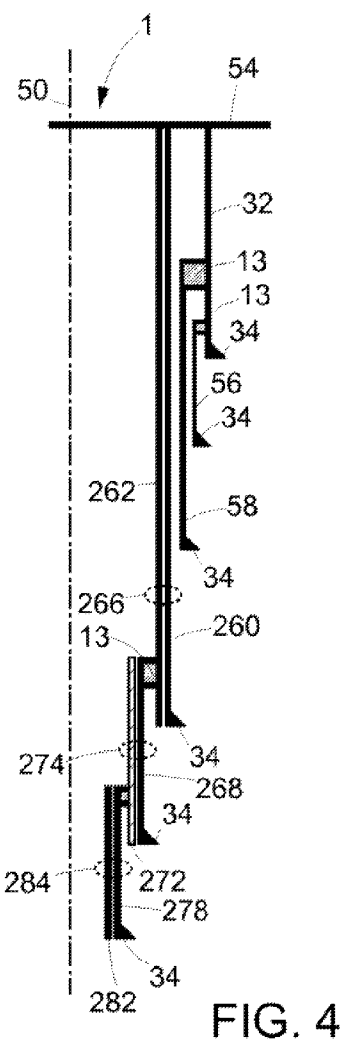
FIG. 4 shows a cross-section of another embodiment of a casing system according to the invention.

FIG. 1 schematically shows an example of a conventionally cased wellbore 1. The wellbore 1 comprises a borehole 4 which has been drilled from the surface 3 through a number of earth formations 5, 6, 7, 8 up to a production formation 9 which may comprise hydrocarbons. The wellbore 1 is lined with a number of nested casings 12, 32, 42 and a liner 15 which is suspended from the inner casing 42 by means of liner hanger 13. The casings may be arranged within conductor pipe 44 having a relatively large inner diameter. Each casing 12, 32, 42 extends further into the wellbore than the corresponding previous casing or pipe. The liner 15 may extend from the inner casing 42 to the production formation 9 and has been provided with perforations 11 to allow fluid communication from the reservoir interval 9 to the wellbore.

The outer casing 12 may also be referred to as surface casing. The casing string 32 which is arranged within the surface casing may also be referred to as intermediate casing. The wellbore may be provided with one or more intermediate casing strings. The inner casing 42 may also be referred to as the production casing. The liner 15 may be referred to as production liner, as it is set across the reservoir interval 9 and perforated to provide communication with the wellbore and a production conduit (not shown). The production casing 42 is typically required to be able to withstand pressures of the reservoir 9. I.e. the production casing preferably has a burst strength and/or a collapse strength which is able to withstand the (gas) pressure in the reservoir 9 along its entire length.

The liner hanger 13 is a device used to attach or hang liners from the internal wall of a previous casing string. The liner hanger 13 may be designed to secure in place the liner 15 and to substantially isolate the interior space 25 of the production casing 42 from the annular space 15 of the production liner 15. For example, the liner hanger 13 comprises means for securing itself against the wall of the casing 42, such as a slip arrangement, and means for establishing a reliable hydraulic seal to isolate the annular space 25, for instance by means of an expandable elastomeric element. In general, the liner hanger is relatively costly due to the severe requirements it should meet.

The conductor pipe 44, the casings 12, 32, 42 and the liner 15 all may be provided with a corresponding casing shoe 34. The annulus between a respective casing and the previous casing has typically been filled with a material 36 such as cement, either partially or fully.

A wellhead or casing head 2 may cover the surface ends of the casings 12, 32, 42 and the conductor pipe 44. During drilling, a blow out preventer (BOP) 16 is installed on the wellhead 2 to enable control of the wellbore and for fluid flow in and out of the wellbore. The BOP may be provided with one or more rams, such as blind ram 46 and pipe ram 47, an annular blow out preventer 41 and one or more valves 48 to connect to pipelines. The latter typically include one or more of a choke line, kill line 49, flow line 51.

FIG. 2 shows an example of a conventional casing scheme 52 for a wellbore 1. The casing scheme is circular symmetrical around midline 50. FIG. 2 shows a downhole part of the casing scheme 52, whereas an upper part above line 54 may be similar to the casing scheme as shown in FIG. 1.

The casing scheme includes intermediate casing strings 32, 42. Casing 32 may be provided with a first liner 56 and a second liner 58, both suspended from corresponding liner hangers 13. The inner casing 42 may be provided with a third liner 60, which is suspended from corresponding liner hanger 13. The third liner 60 is provided with a fourth liner 62, which likewise is suspended from corresponding liner hanger 13.

As an example, casing 32 may have an outer diameter (OD) of 22 inch. First liner 56 may have an OD of 18 inch, and second liner 58 may have an OD of 16 inch. Casing 42 may have an outer diameter 14 inch. Third liner 60 may have an OD of 11¾ inch, and fourth liner 62 may have an outer diameter of 9⅝ inch.

The wellbore 1 may have a relatively large total depth of, for instance, more than 15,000 feet or even more than 25,000 feet. Recently, wellbores may have a total depth in the order of 30,000 feet or more. Herein, total depth indicates the distance between the planned end of the wellbore and a starting point or datum. Said datum may for instance be positioned at ground level (GL), drilling rig floor (DF) or mean sea level (MSL). The total depth can be measured by the length of pipe required to reach the end of the wellbore. Depth in the wellbore indicates the distance between the datum and a location in the wellbore in general.

The intermediate casing(s) and the production casing will have to extend over a substantial part of the total depth, and will consequently have to extend over longer distances when the total depth increases. At the same time, each casing or liner will have to be able to withstand the expected downhole pressures, either from the outside or from the inside of the pipe. Herein, the maximum pressure a casing can withstand correlates for instance to the wall thickness and to the strength of the material of the pipe. In general, increasing total length, increasing wall thickness or stronger material will increase the total weight of the respective casing or liner.

The present invention discloses a system and method, wherein the casing scheme includes one or more casings or liners which comprise a combination of two or more layers. Herein, the collapse and burst strength of the combination of the two or more layers exceeds the pressure requirements of the wellbore, but each of the layers individually may not. The method and system of the invention enable the use of thinner walled casing and liner layers, which can be handled by currently available rigs. In addition, the casing scheme of the invention allows the use of a rig having a lower capacity, which may reduce costs compared to a conventional casing scheme which will require a rig having a higher capacity. Notwithstanding the aforementioned advantages, the assembly of casing layers can provide sufficient strength, even for deeper wellbores, stern regulations, or high pressures. Due to the combination of casing layers, the casing scheme of the invention may reduce the total required volume of steel compared to a conventional casing scheme for the same wellbore, due to more efficient use of casing steel in the wellbore. The present invention differs from conventional casing schemes substantially as it builds upon the previously installed casing rather than replacing the previously installed casing.

Figure 3:
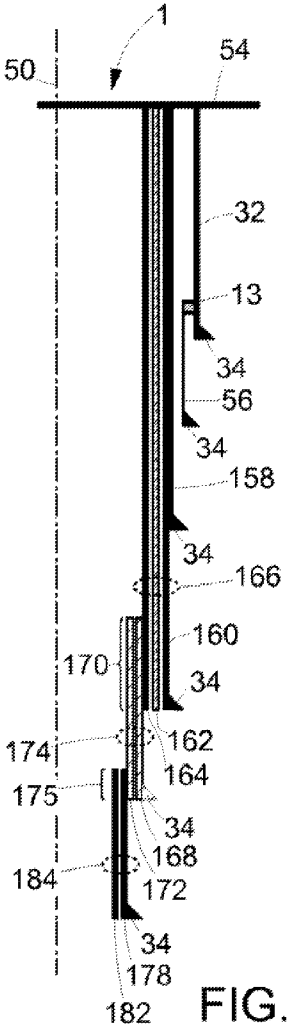
FIG. 3 shows a cross-section of an embodiment of a casing system according to the invention.

FIG. 3 shows the wellbore of FIG. 2, but including a casing scheme according to the present invention. The wellbore 1 includes the casing 32, provided with the liner 56 which is suspended from liner hanger 13.

Subsequently, the casing scheme includes casing 158. Casing 158 is lighter than casing 58, although they have substantially the same length. For instance, the wall of casing 158 (FIG. 3) may be thinner than the wall of casing 58 (FIG. 2). A subsequent section of the wellbore is provided with a casing 160. The casing 160 may extend to the same depth in the wellbore as the casing 42 in FIG. 2. After introduction of the casing 160 to the planned depth, the casing 160 may be expanded over its entire length. Herein, the casing 160 is expanded against the inner surface of the casing 158 over the entire length thereof. One or more casing clads, such as first casing clad 162 and second casing clad 164, may be introduced in the wellbore and expanded against the inner surface of the expanded casing 160. The casing clads 162, 164 herein extend to substantially the same depth as the casing 160, and are expanded over the entire length thereof against the casing 160 to form a combined casing 166.

A subsequent section of the wellbore 1 is provided with liner 168. After introduction in the wellbore, the liner 168 is expanded over its entire length. The liner 168 overlaps at least part of the inner surface of the combined casing 166. The overlap section 170 has a length which is sufficient for the forces between the expanded liner 168 and the combined casing 166 to maintain the liner 168 in the predetermined position. One or more liner clads, such as first liner clad 172, may be introduced in the wellbore and thereafter expanded against the liner 168. Together, the liner 168 and the liner clad 172 form combined liner 174.

A subsequent section of the wellbore 1 is provided with liner 178. After introduction in the wellbore, the liner 178 is expanded over its entire length. The liner 178 overlaps at least part of the inner surface of the combined liner 174. The overlap section 175 has a length which is sufficient for the forces between the expanded liner 178 and the combined casing 174 to maintain the liner 178 in the predetermined position. One or more liner clads, such as second liner clad 182, may be introduced in the wellbore and thereafter expanded against the liner 178. Together, the liner 178 and the liner clad 182 form combined liner 184.

In another embodiment, shown in FIG. 4, the wellbore 1 is provided with the casing 32. Liners 56 and 58 are suspended from corresponding liner hangers 13. Casing 260 is introduced in the wellbore. A casing clad 262 is introduced with the casing 260 and expanded over its entire length, against the inner surface of the casing 260. Together, casing 260 and casing clad 262 forms combined casing 266. A liner 268 is arranged within the combined casing 266 and is suspended from liner hanger 13. Liner clad 272 is arranged within the liner 268 and expanded over its entire length against the inner surface of the liner 268. Together, the liner clad 272 and the liner 268 form combined liner 274. A second liner 278 is arranged within the combined liner 274 and is suspended from liner hanger 13. Second liner clad 282 is arranged within the liner 278 and expanded over its entire length against the inner surface of the liner 278. Together, the second liner clad 282 and the liner 278 form combined liner 284.

It is possible to radially expand one or more tubular elements at a desired depth in the wellbore, for example to form an expanded casing, expanded liner, or a clad against an existing casing or liner. Also, it has been proposed to radially expand each subsequent casing to substantially the same diameter as the previous casing to form a monodiameter wellbore. The available inner diameter of the monodiameter wellbore remains substantially constant along (a section of) its depth as opposed to the conventional nested arrangement.

EP-1438483-B1 discloses a method of radially expanding a tubular element in a wellbore. Herein the tubular element, in unexpanded state, is initially attached to a drill string during drilling of a new wellbore section. Thereafter the tubular element is radially expanded and released from the drill string.

The tubular element may be expanded using a conical expander having a largest outer diameter which is substantially equal to the required inner diameter of the tubular element after expansion thereof. The expander may be pumped, pushed or pulled through the tubular element.

WO-2008/006841 discloses a wellbore system for radially expanding a tubular element in a wellbore. The wall of the tubular element is induced to bend radially outward and in axially reverse direction so as to form an expanded section extending around an unexpanded section of the tubular element. The length of the expanded tubular section is increased by pushing the unexpanded section into the expanded section. Herein the expanded section retains the expanded tubular shape after eversion. At its top end, the unexpanded section can be extended, for instance by adding pipe sections or by unreeling, folding and welding a sheet of material into a tubular shape.

The above described method and system may be used in combination with the present invention to expand clads and make for instance the combined casings 166, 266 or the combined liners 174, 184, 274, 284.

Figure 5A:
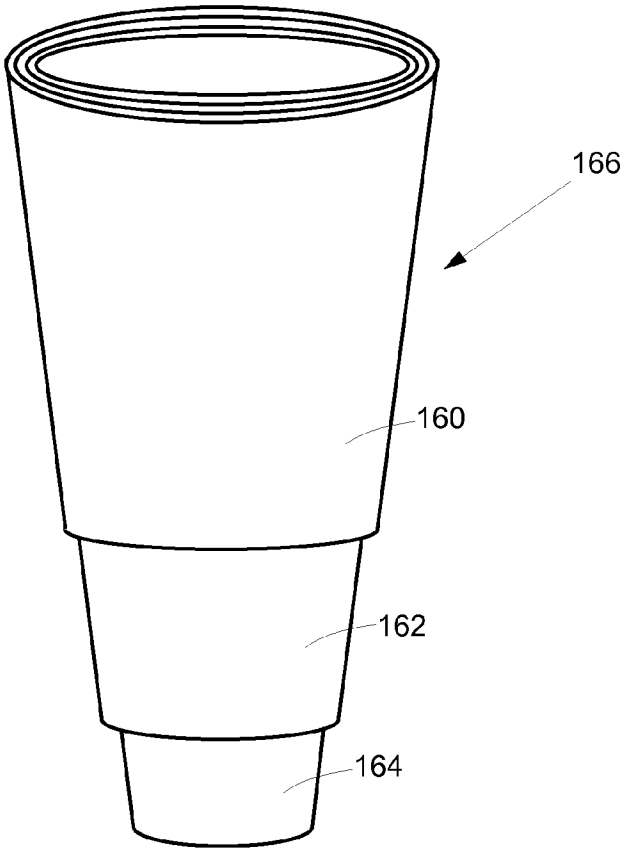
FIG. 5A shows a perspective view of a combined casing according to the present invention.

FIG. 5A shows a cross-section of a part of the combined casing 166 according to the present invention. The combined casing 166 comprises first tube 162 and second tube 164 arranged within a third, outer tube 160. The first tube 162 and the second tube 164 are expanded. Herein, the outer surface of the first tube 162 is pressed against the inner surface of the outer tube 160. The outer surface of the second tube 164 is pressed against the inner surface of the expanded first tube.

The first tube 162 and the second tube 164 may be expanded to create an interference fit between the respective tubulars. Herein, the second tube 164 is expanded such that its outer diameter exceeds the inner diameter of the third tube 160. The first tube 162 is subsequently expanded such that its outer diameter exceeds the inner diameter of the expanded second tube 164. Herein, two adjacent tubes interfere with each others occupation of space. The result is that they elastically deform slightly, each being compressed, and the interface between them is one of extremely high friction.

As a result of said interference fit, the outer tubular will be in circumferential tension and the inner tubular will be in circumferential compression. Referring to the triple walled pipe assembly 166 of FIG. 5A, the outer tubular 160 is in circumferential tension and the intermediate tubular 162 is in circumferential compression with respect to the outer tubular 160. Likewise, the intermediate tubular 162 is in circumferential tension with respect to the inner tubular 164 and the inner tubular 164 is in circumferential compression with respect to the intermediate tubular 162.

By using an interference fit at the overlap section of respective tubulars, a liner hanger is obviated. See in this respect for instance the overlap sections 170 and 175 in FIG. 3.

FIGS. 5B to 5F show diagrams to illustrate the interfence fit.

FIGS. 5B and 5C show a cross section of the wall of a single walled pipe 290 having a predetermined wall thickness t1. The left side of each Figure indicates the interior of the pipe and the right side indicates the exterior. The diagrams superposed on the Figures indicate the radial stress $\sigma_r$ and the circumferential stress $\sigma_\theta$ for a situation wherein either an internal pressure $P_{int}$ (FIG. 5B) or an external pressure $P_{ex}$ (FIG. 5C) is applied to the pipe wall.

FIG. 5D shows a double walled pipe, for instance tubulars 160 and 162 as shown in FIG. 5A, having wall thickness t2 and t3 respectively. It is assumed the both tubular 160 and 162 are made of the same material as pipe 290. Herein, (t2+t3)=t1. The tubulars are arranged in interference fit. As a result, in the absence of internal or external pressure the walls press against each other, inducing a radial and circumferential pre-stress in the walls of the pipes 160, 162 (FIG. 5D).

When internal pressure $P_{int}$ (FIG. 5E) or external pressure $P_{ex}$ is applied to the composite pipe wall, the pre-stresses effectively reduce the difference between the circumferential stress and the radial stress at the inner surface of the outer pipe 160. The latter effectively increases the collapse and/or burst strength of the double-walled pipe relative to a single walled pipe having the same wall thickness.

Figure 6:
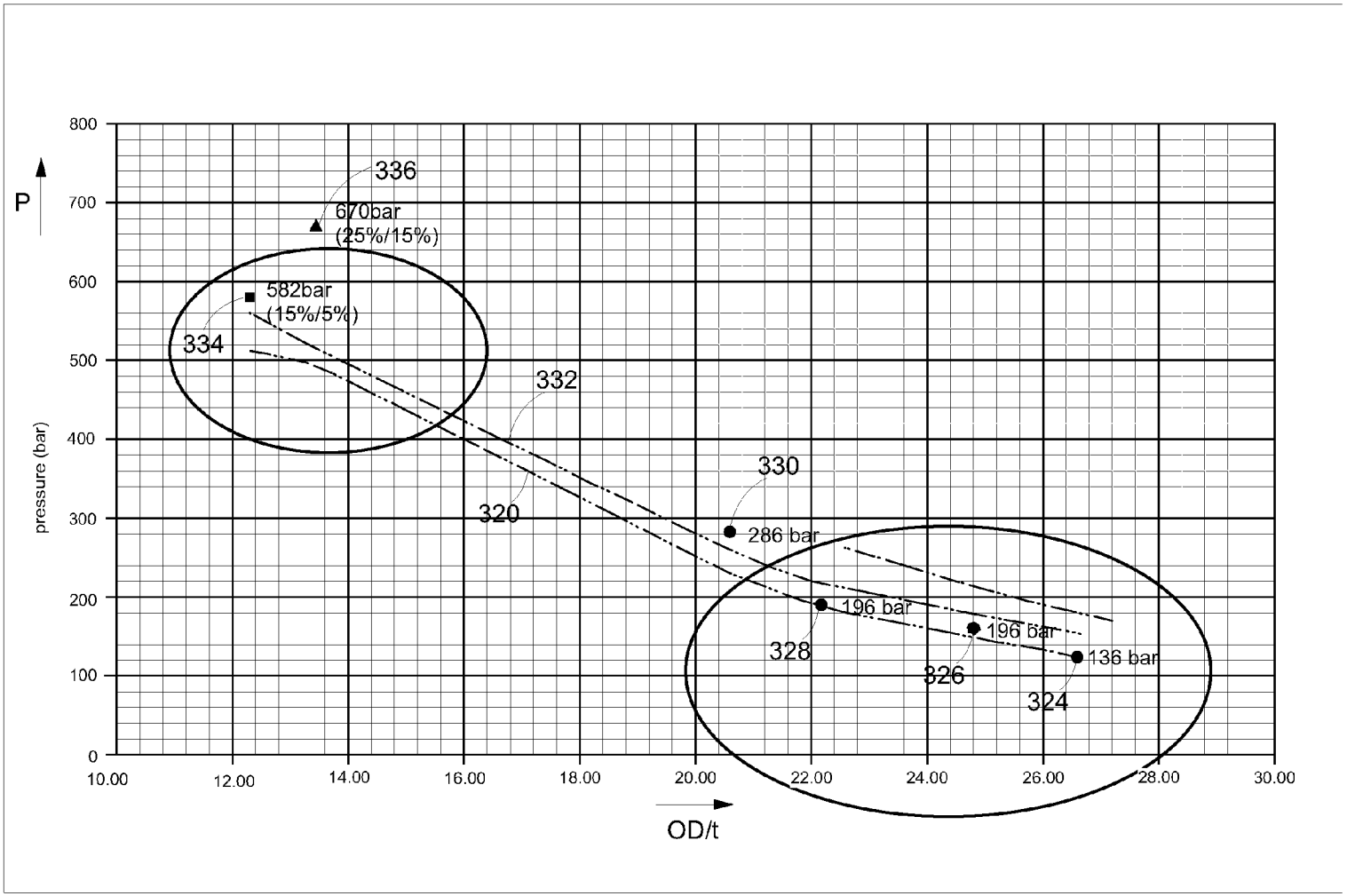
FIG. 6 shows a diagram indicating calculated collapse strength of single walled pipes and the measured collapse strength of double walled pipes for use in the system or method of the invention.

The graph of FIG. 6 shows test data of the collapse pressure of various samples. Herein, the y-axis indicates the pressure P [bar] and the x-axis indicates the ratio OD/t, i.e. the outer diameter OD (after expansion, if any) versus the wall thickness t. Line 320 indicates a prediction of the collapse pressure of a single walled pipe calculated using finite element analysis (FEA). Line 322 indicates the collapse pressure ratings of a single walled pipe as prescribed by the American Petroleum Institute (API).

Test results 324-330 of single walled pipes are substantially within a few % of the predictions of both lines 320 and 322. Samples 334, 336 concern double walled pipes wherein one pipe is expanded within another pipe using the above-described interference fit, i.e. the outer diameter of the inner pipe after expansion is slightly larger than the inner diameter of the outer pipe. Test results 334 and 336 of double walled pipes indicate that the collapse pressure of the double walled pipes using interference fit is at least equal to the theoretical collapse pressure of a single walled pipe having the same wall thickness, but can be slightly, for instance in the range of 2-10% (sample 334), or even significantly higher. The collapse strength of sample 336 exceeds the predictions of lines 320, 322 with more than 20%, for instance with about 30% to 40%.

Similar results were obtained with respect to the burst strength of the pipes. I.e., the burst pressure of double walled pipes using interference fit is at least equal to, but may typically exceed the theoretical burst pressure of a single walled pipe having the same wall thickness. The burst pressure can be slightly larger, for instance in the range of 2-10%, or even more than 20% or 30% larger.

Figure 7:
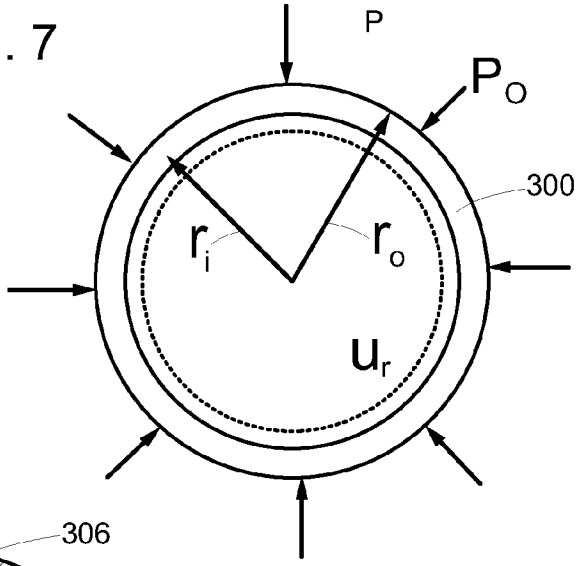
FIG. 7 shows a plan view of a cross section of a pipe.

FIG. 7 provides some additional background to the present invention. A pipe-in-pipe (PIP) configuration is a configuration wherein a first pipe is arranged within a second pipe. Collapse failure is a major concern for this type of application. When a pipe is expanded inside another pipe, a gap or distance between the two pipes may exist after expansion. The size of said gap can influence the collapse strength of the PIP structure. Lab testing and finite element analysis (FEA) were performed to evaluate the predictive power of the FEA in PIP collapse.

A critical gap size (CGS) can be defined. The displacement $u_r$ of the inner diameter $r_i$ of a thick-walled pipe 300 when exposed to external pressure $P_o$ can be expressed as:

$$u_r = \frac{r_i}{E}\left(\frac{-2P_o r_o^2}{r_o^2 - r_i^2}\right) \quad [1]$$

wherein E is Young's modulus and $r_o$ is the outer diameter (OD) of the pipe. Displacement $u_r$ is the radial elastic displacement of the pipe ID $r_i$ at pressure $P_o$. When $P_o$ equals the collapse pressure $P_c$ of the pipe, $u_r$ equals CGS:

$$CGS = \frac{r_i}{E}\left(\frac{-2P_c r_o^2}{r_o^2 - r_i^2}\right) \quad [2]$$

For example, a pipe having an outer diameter of 9⅝ inch and weighing about 36# (lb/ft) may have a collapse pressure in the order of 3000 to 3500 psi (tested). The CGS is in the order of 0.005 to 0.009 inch, for instance about 0.007 inch. When using this pipe as the outer pipe in a pipe-in-pipe system, the gap between the outer diameter of the inner pipe and the inner diameter of the outer pipe is preferably less than the CGS.

Figure 8:
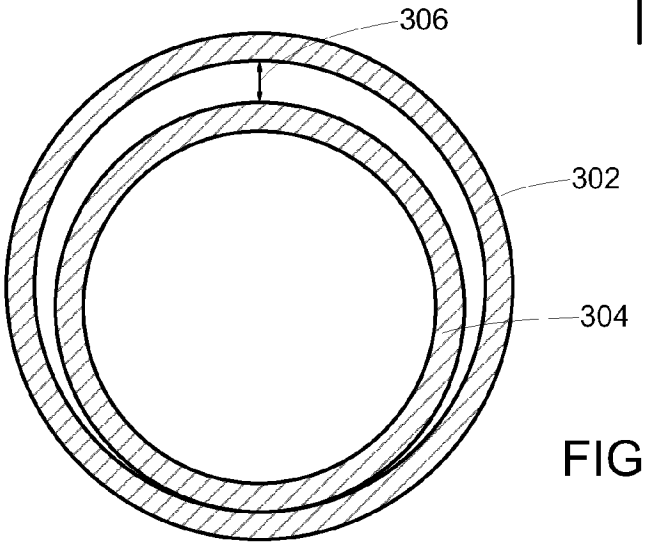
FIG. 8 shows a plan view of a cross section of a pipe arranged within another pipe, wherein the gap size is indicated.

FIG. 8 shows a cross-section of a first pipe 302 enclosing a second pipe 304. The gap or distance 306 between the two pipes is defined as the largest distance in radial direction between the outer surface of the inner pipe 304 and the inner surface of the outer pipe 302 at a certain position along the length of the two pipes. The critical gap size (CGS) is the recommended maximum distance in radial direction at any position along the length of the two pipes.

Figure 9:
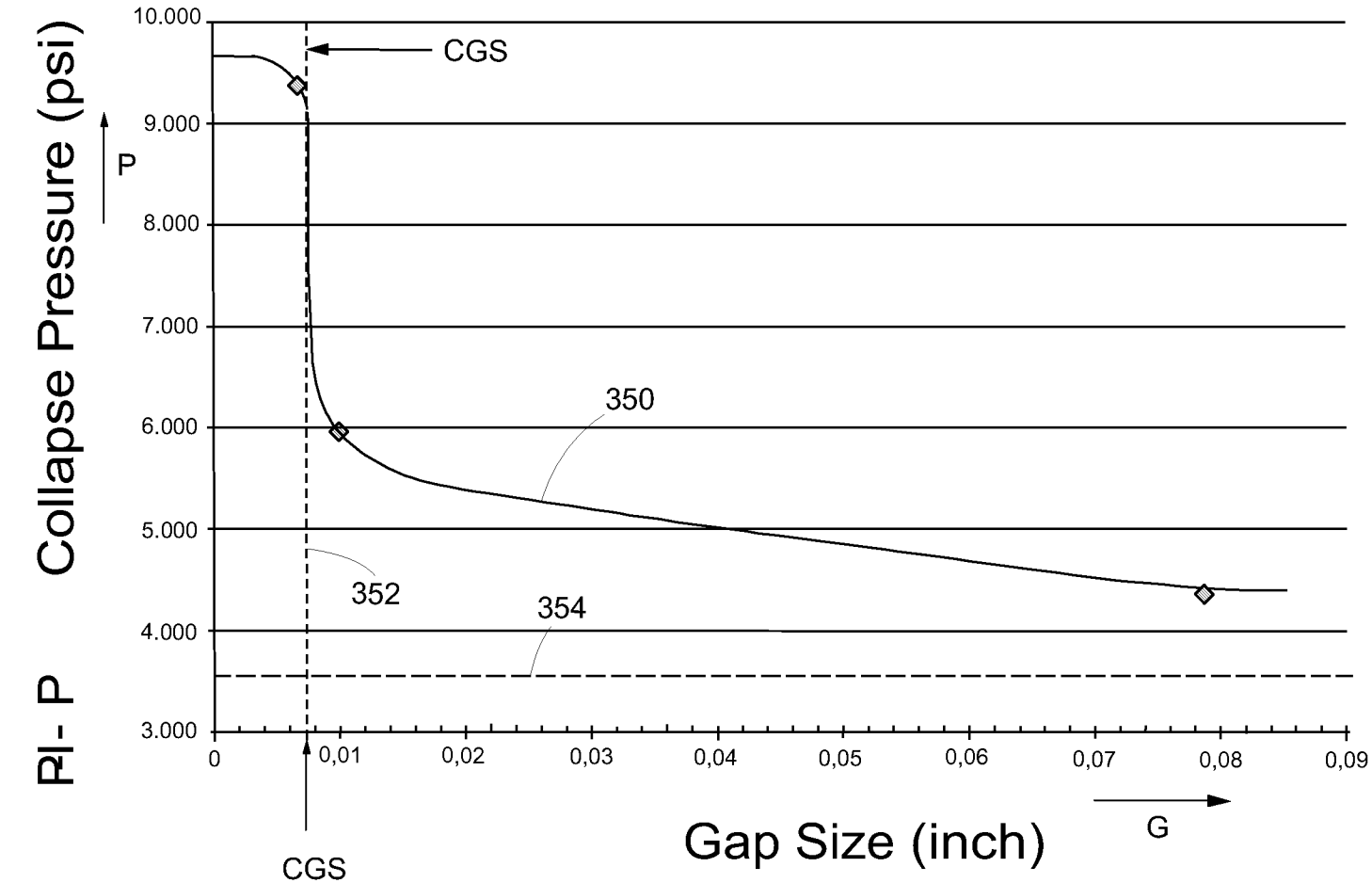
FIG. 9 shows a diagram indicating an example of collapse pressure of a pipe-in-pipe depending on the gap size between the two pipes.

Tests have indicated the validity of the CGS criterion. For instance, the graph of FIG. 9 shows an example of test results of the collapse pressure of a pipe 304 arranged within another pipe 302 in relation to the size of the gap 306 between said two pipes. The y-axis indicates pressure P [psi] and the x-axis indicates the gap size G [inch]. Line 350 is fitted to the test results. The vertical dotted line 352 indicates the critical gap size CGS as calculated using formula [2] above for the particular two pipes corresponding to the example of FIG. 9. Line 354 indicates the collapse pressure of the outer pipe 302 in the absence of the inner pipe 304.

Line 350 indicates a decrease of the collapse pressure of about 30% or more when the gap size exceeds the CGS. When the gap size is smaller than the CGS, for instance about 1-20% smaller, the collapse pressure is for instance more than 9000 psi. The latter value corresponds to or exceeds the calculations or predictions as shown in FIG. 8. In the example, the collapse pressure of the combined pipe is about 2.5 to 3 times larger then the collapse pressure of the outer pipe 302 alone, as long as the gap is smaller than the CGS. Using the same pipes but with a gap size slightly larger than the CGS, for instance about 5-35% larger, the collapse pressure decreases with more than 20 to 30%, for instance to a value below 6000 psi, or less than twice the collapse pressure of the outer pipe 302. The collapse pressure decreases further for larger gaps, for instance a decrease of about 40% when the gap size is about two time the CGS, and up to a decrease of more than 50%. Similar results were obtained with respect to the burst pressure.

The table in FIG. 10A shows an example of a calculation of a casing scheme, using the method of the invention. The exemplary casing scheme includes four casing strings, labeled string no. 1 to 4 in the first column. Casing strings 1 and 2 may have the same outer diameter (OD), and casing strings 3 and 4 may have the same OD, as shown in the second column. Wallthickness t is indicated in the third column. The fourth column indicates the expansion ratio for expanding the pipe diameter. The sixth, seventh and eighth column indicate the inner diameter (ID), wallthickness t and OD after expansion. Herein, the OD of casing string 3 is about equal to the ID of casing string 4, etc. I.e., after expansion casing string 1 fits within casing string 2 wherein the outer surface of casing 1 engages the inner surface of string 2. String 2 fits with casing string 3, which fits within casing string 4. As a result, after expansion the casing strings 1-4 provide an assembly of four casings, similar to the assembly shown in FIG. 5. Columns 13 and 14 indicate the burst pressure Cum burst and the collapse pressure P-y of the assembly of the respective casing string combined with the casing strings having a higher number. Herein, the value for casing string 1 indicates the cumulative burst and collapse pressure of the assembly of casings 1 to 4 combined. As indicated in table 1, the combined casing according to the invention can provide a predetermined cumulative burst and collapse pressure up to at least 15,000 psi or more. The strength of the combined casing can for instance be adjusted by using more or less casings in combination or by adjusting the wall thickness of one or more of the casings.

The table of FIG. 10B shows a more elaborate casing scheme according to the invention. The casing scheme includes 13 casing strings, labeled 1 and 1 to 12 in the first column. The casing string no. 1 on the first line of the casing scheme may be a production tubing. Weight [pounds per foot], OD [inch], wall thickness t [inch] and running clearance [inch] are indicated in columns two to five respectively. Expansion ratio [% expansion of the OD] is indicated in the sixth column. ID [inch], wall thickness t [inch] and OD [inch] after expansion are indicated in columns seven to nine respectively. As with the casing scheme of FIG. 10A, after expansion the OD of a particular casing string is about equal to the ID of a previous casing string. I.e.: The OD after expansion of casing string no. 1 is about equal to the ID after expansion of casing string no. 2; the OD after expansion of casing string no. 2 is about equal to the ID after expansion of casing string no. 3, etc.

Figure 11:
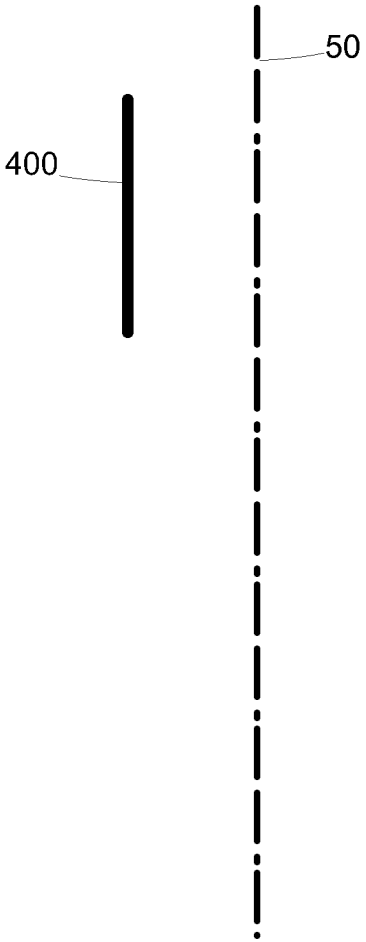

FIG. 11 shows an outer casing 400, which is for instance comparable to the conductor pipe 44 or one of the casings 32, 42 shown in FIG. 1. In a preferred embodiment, the casing 400 is a surface casing. The casing 400 may be arranged in a wellbore, which is however not shown.

Figure 12:
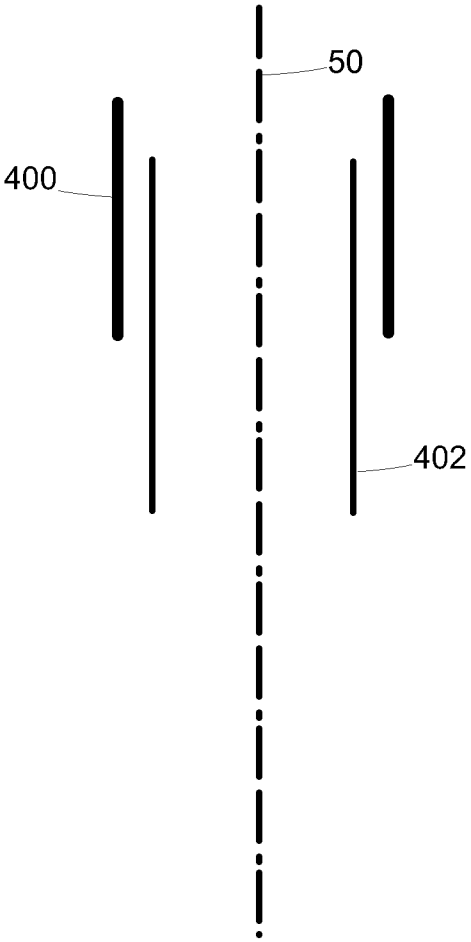

In a next step, shown in FIG. 12, a second casing string layer 402 may be introduced in the wellbore, through the casing layer 400, until the casing 402 has reached a predetermined position. The outer diameter of the casing 402 is smaller than the inner diameter of the casing 400.

Casing string herein may indicate a string of tubular casing parts connected to one another, for instance by treaded connections. Each tubular casing part may have a length in the order of 10 to 20 meters, whereas the casing string may have a length in the range of a few hundred meters up to several kilometer or more.

Figure 13:
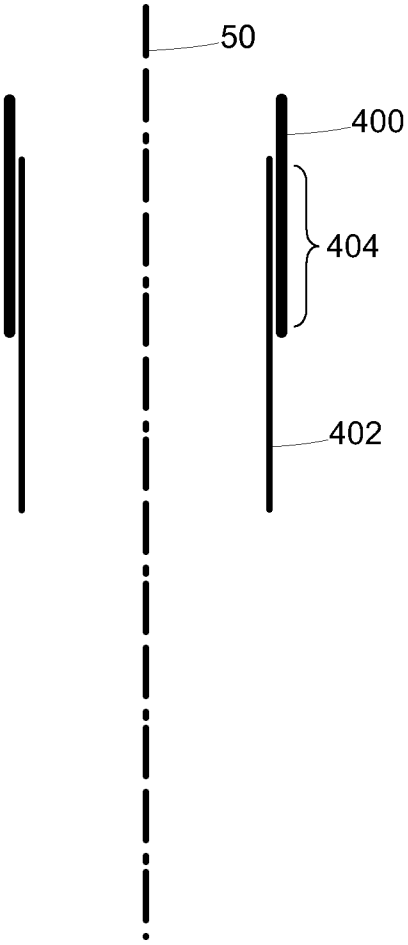
FIGS. 11 to 27 schematically show consecutive steps of an embodiment of the method according to the invention.

Subsequently (FIG. 13), the casing string 402 is expanded, i.e. the inner and outer diameter of the casing string 402 are increased. Expanding the casing 402 may be done using an expander (not shown) having an outer diameter which exceeds the inner diameter of the casing 402, which is pulled or pushed through the casing 402. During expansion, the respective casing string is held in place using any suitable means. The latter may include any of an anchor arranged at the outside of the tubular at for instance the upper or lower end of the tubular, an anchor between the tubular and a drill string extending within said tubular, a hydraulic jack to move the expander and at the same time hold the tubular, etc.

After expansion, the outer diameter of the expanded casing 402 is about equal to or larger than the inner diameter of the casing 400. As a result, the outer surface of casing 402 engages the inner surface of the casing 400 along an overlap section 404. The length of the overlap section 404 may be more than 50% of the length of the casing 402.

Figure 14:
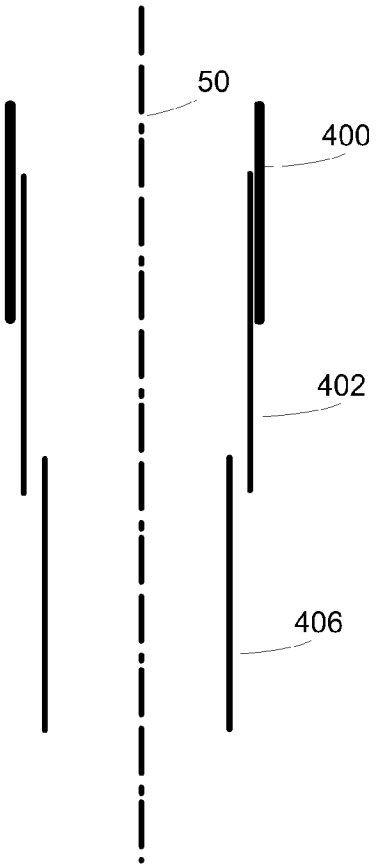

In an embodiment (FIG. 14), an additional second casing string part 406 may be introduced through the second casing 404 until it has reached a predetermined location. The outer diameter of the second casing string part is smaller than the inner diameter of the expanded second casing string 402.

Subsequently (FIG. 15), the second casing string part 406 is expanded. Preferably, the inner diameter of the expanded second casing string part is about equal to the inner diameter of the expanded second casing string 402. At an overlap section 408, the outer surface of the second casing string part engages the inner surface of the second casing 402. Preferably, along the overlap section the inner diameter of the expanded second casing string 402 is expanded even further, and the inner diameter of the expanded second casing string part 406 is substantially similar to the inner diameter of the second casing string 204 along its entire length.

Figure 16:
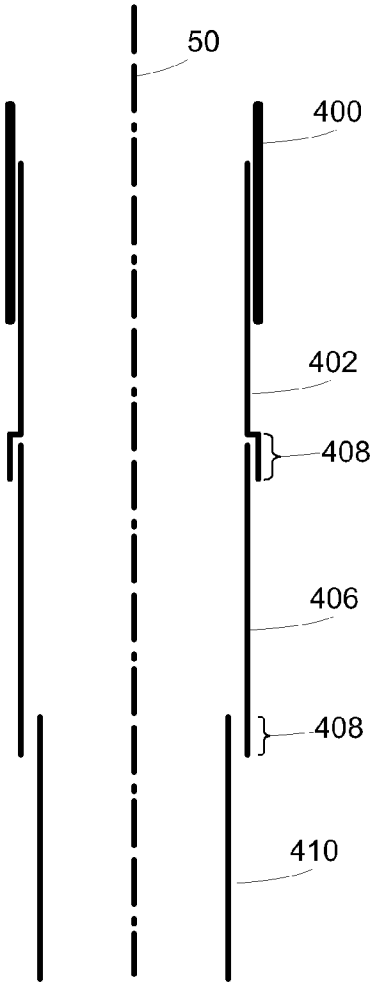
Figure 15:
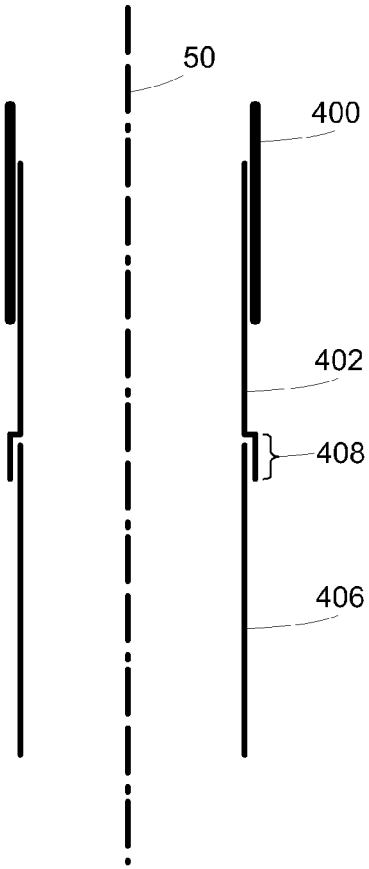
Figures 17, 18, 19:
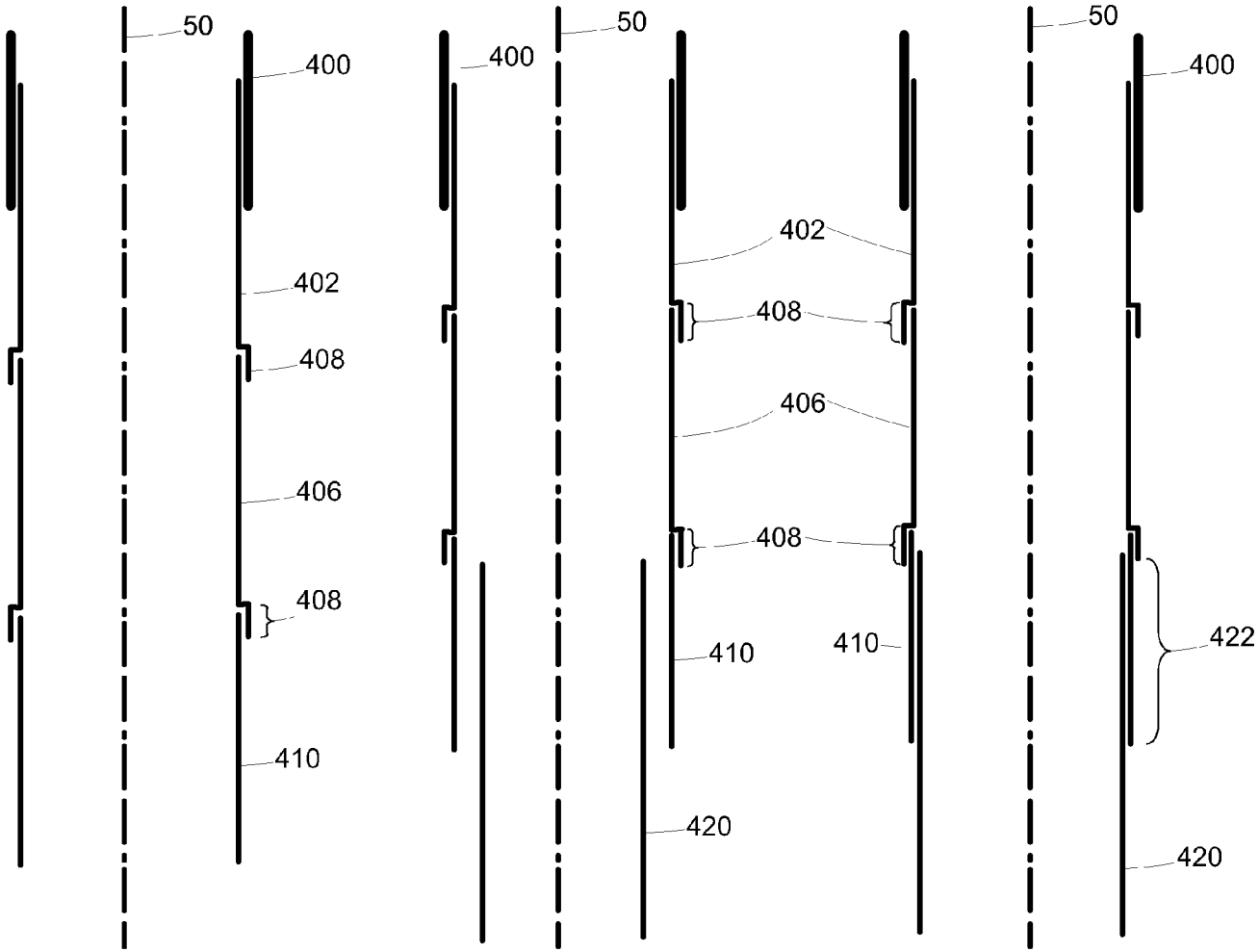

FIG. 16 shows the introduction of another second casing string part 410, which may subsequently be expanded as shown in FIG. 17. The steps of introducing a second casing string part and the expansion thereof, as shown in FIGS. 15 and 16, may be repeated until the assembly of second casing string 402 and additional second casing string parts has a predetermined length.

In a next step (FIG. 18), a first casing layer 420 may be introduced through the expanded second casing string and the corresponding expanded second casing string parts.

As shown in FIG. 19, the first casing layer 402 may subsequently be expanded after it has reached a predetermined position. After expansion, the outer diameter of the first casing layer 420 is about equal to or larger than the inner diameter of the expanded additional second casing part 410. Along an overlap section 422, the outer surface of the first casing layer 420 engages the inner surface of the expanded additional second casing part 410.

Figures 20, 21, 22:
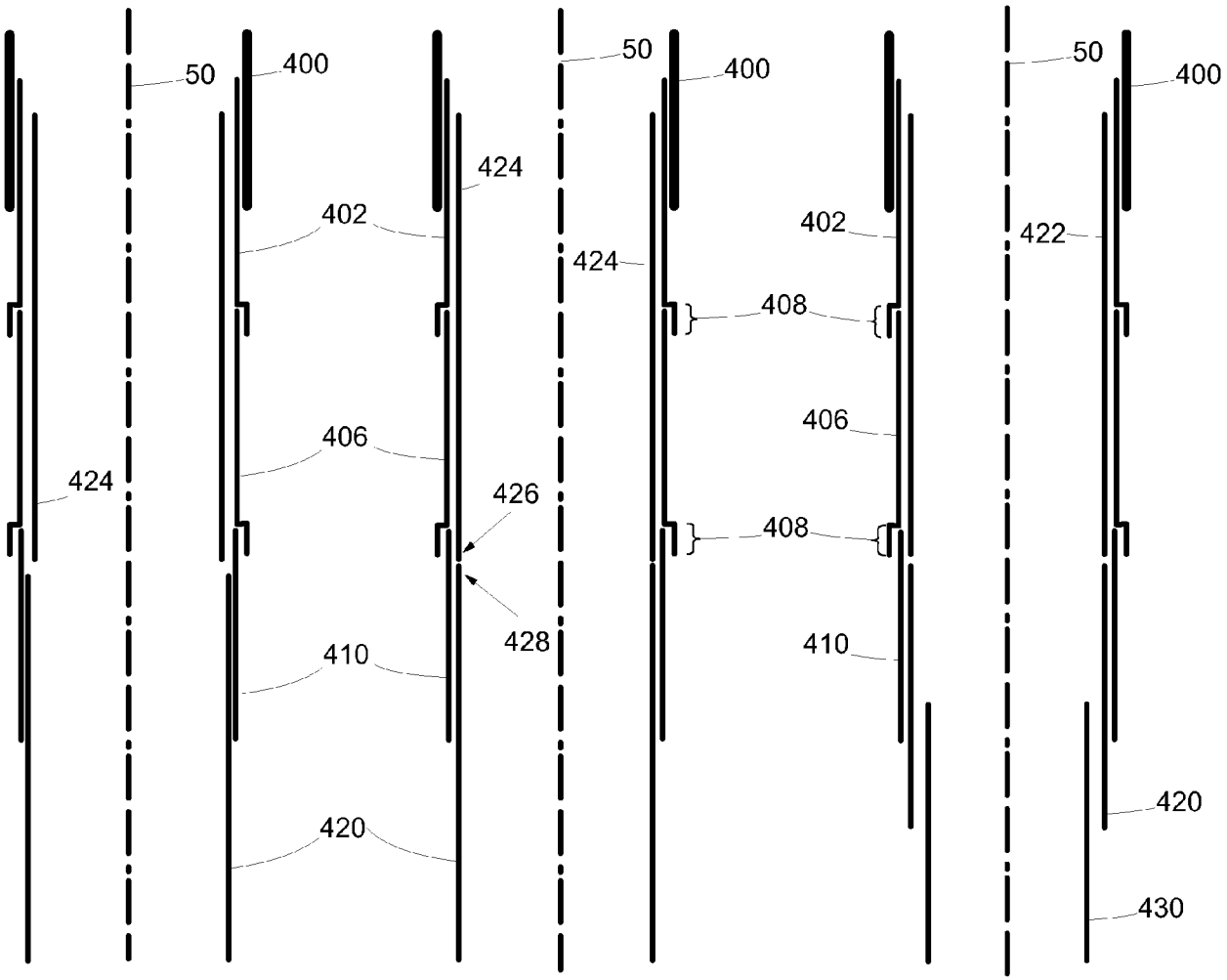

Thereupon, an additional first casing layer part 424 may be introduced (FIG. 20). In a predetermined position, a downhole end 426 of the additional first casing layer part 424 substantially engages a top end 428 of the first casing layer 420.

The additional first casing layer part 424 may be expanded in a next step (FIG. 21). After expansion, the outer surface of the additional first casing layer part 424 engages the inner surface of the assembly of second casing string 402 and additional second casing string parts 406, 410 along substantially its entire length.

A second casing layer 430 may subsequently be introduced (FIG. 22).

In a next step (FIG. 23), the second casing layer 430 may be expanded. Along an overlap section 432, the outer surface of the expanded second casing layer 430 preferably engages part of the inner surface of the assembly of second casing string 402 and additional second casing string parts 406, 410. The length of the overlap section 432 may be about 50% or more of the length of the second casing layer 430.

Subsequently (FIG. 24), an additional second casing layer part 434 may be introduced. In a predetermined position, a downhole end 436 of the additional second casing layer part 434 substantially engages a top end 438 of the first casing layer 430.

Figures 23, 24, 25:
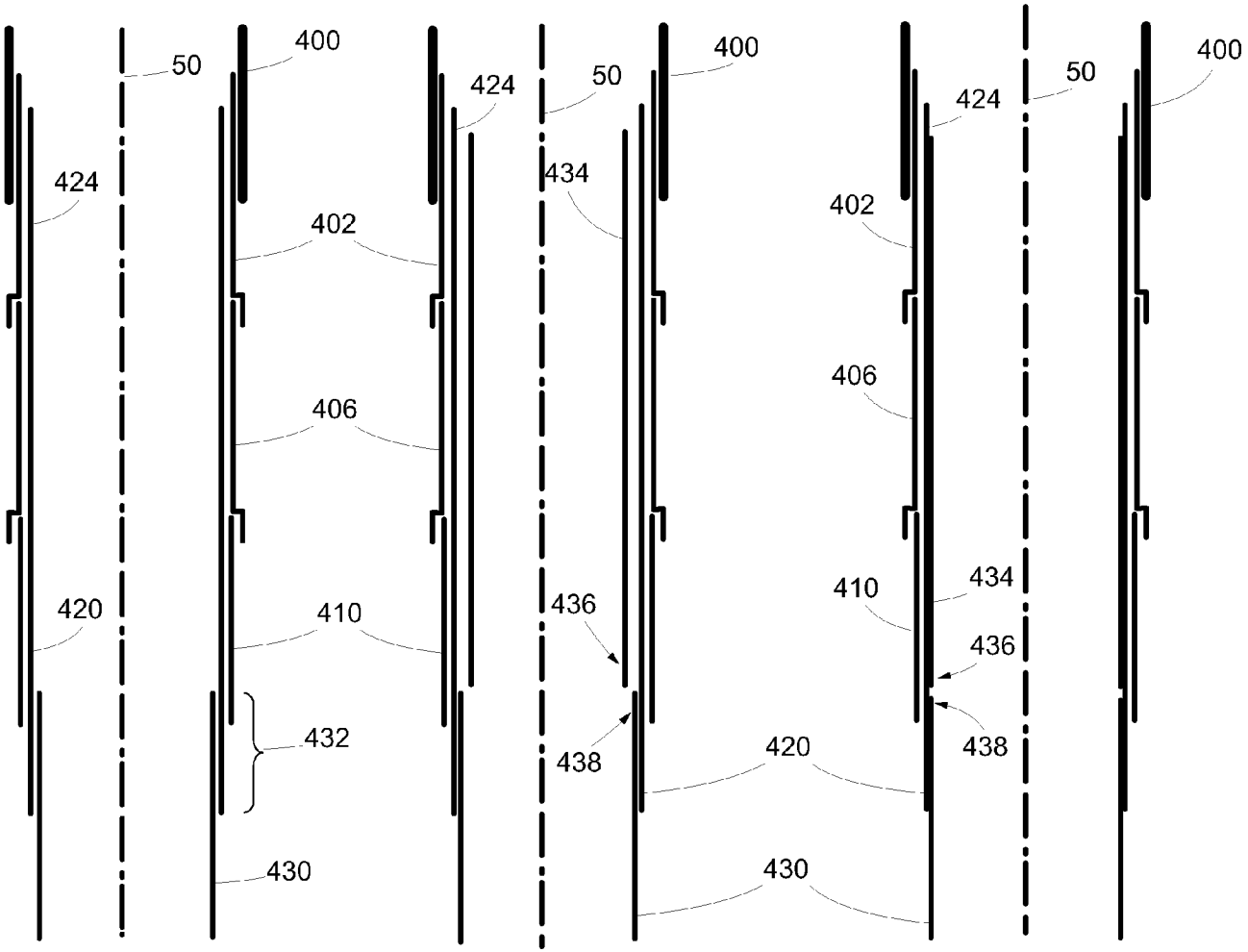

The additional second casing layer part 434 may be expanded in a next step (FIG. 25). After expansion, the outer surface of the additional second casing layer part 434 engages the inner surface of the assembly of first casing layer 430 and additional first casing layer part 424 along substantially its entire length.

Figures 26, 27:
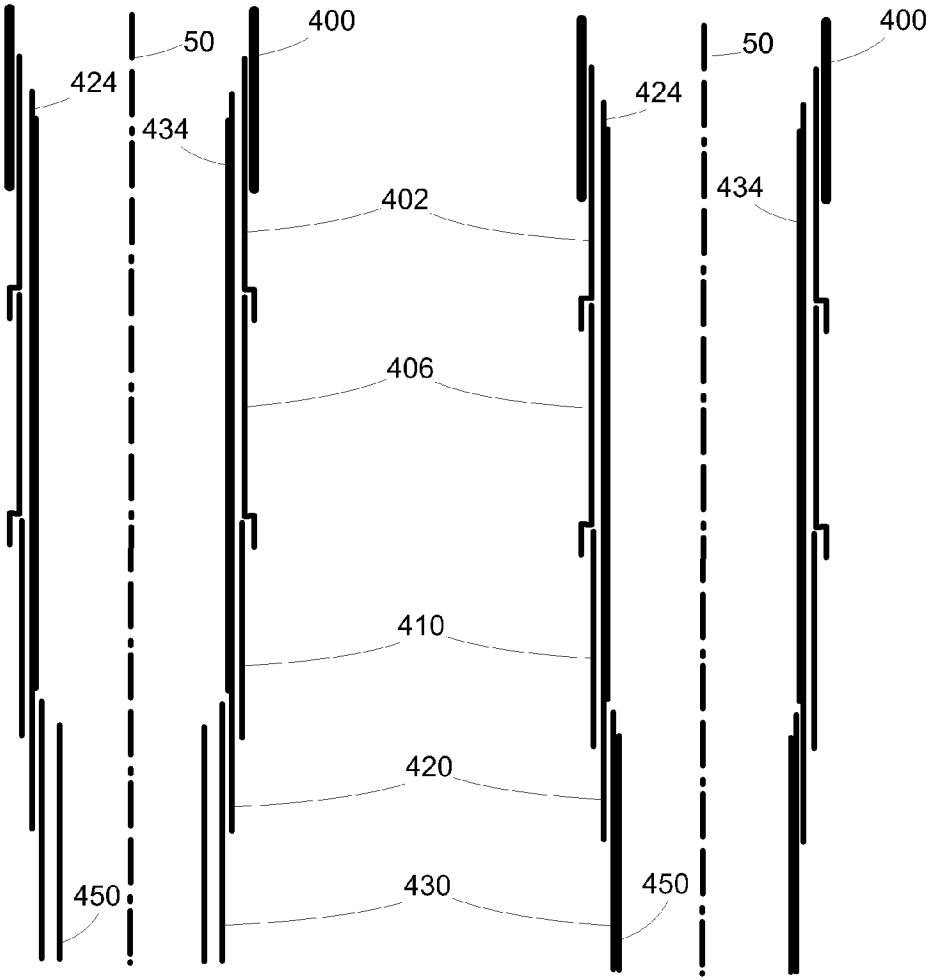

A third casing layer 450 may subsequently be introduced (FIG. 26).

In a subsequent step (FIG. 27), the third casing layer may be expanded. After expansion, the outer surface of the third casing layer engages the inner surface of the second casing layer 430. The overlap section 452 may extend along about 90% or more of the length of the third casing layer 450.

The embodiment of the method as described above and referring to the FIGS. 11 to 28 provide examples. Each of the steps and casing layers can be used in a casing scheme according to the present invention, either alone or in a combination of any number of casing layers, depending on one or more of the requirements of the wellbore, formation conditions, total depth, etc.

The present invention provides a method and system utilizing various casing types in combination. This may include the changing of one or more of the outer diameter (OD), the inner diameter (ID), or the material properties of the casing downhole to enhance the previous, existing casing in the wellbore. The method and system of the invention eliminate at least some of the annular spaces between the successive casing layers. Therefore, the casing scheme of the invention eliminates the problems arising the annular pressure build up in these annular spaces. Also, the invention obviates the use of cement between respective casing layers.

One way to accomplish this is to expand one casing against a previous casing and thus combining the properties of both casings and enhancing the mechanical properties of the casing scheme. Expansion is not the only method to complete this task, and alternatives include for instance: memory steels, explosives, hydraulic forming, inflation, etc.

In a practical embodiment, a casing layer may have a wall thickness in the range of about 0.25 inch (6 mm) to about 0.75 inch (2 cm), for instance about 0.5 inch.

Referring to the embodiments of FIG. 3, the assembly of casing layers 166 may have a combined wall thickness exceeding 1 inch. The assembly of casing layers 174 and 184 may have a combined wall thickness in the order of 1 inch.

The production casing string, for instance casing 160, 260 in FIGS. 3 and 4, may be Q125 API tubing and/or made of API P110 alloy steel. Collapse pressure of the outer tubular may be in the order of 5000 to 7500 psi. The first casing layer 162, 262 may have a wall thickness in the range of about 0.4 to 0.6 inch (10 to 15 mm). The strength of the first casing layer may be in the order of 50,000 psi. The collapse strength of the assembly of casing layer 160 and casing layer 162 may exceed 11,000 psi.

By combining the material properties of the casing, instead of replacing each casing string with a single stronger but also heavier casing string, increased mechanical properties can be achieved. One or more of the annular spaces between respective casing strings can be eliminated, thus obviating the associated complications with having an annulus between successive casing schemes, such as pressure build up. In addition, the casing system and method of the invention, using combined casings, enable to create a strong casing using a combination of two or more lighter casing layers. The strength of the combined casing enables the applicant to comply with legislation, to make more slender wellbores and/or to increase the total depth of wellbores, while using an existing (for instance floating) drilling rig having a limited load capacity. Herein, the weight of the combined casing may exceed the load capacity of the drilling rig, while the weight of each of the separate casing layer of said combined casing is less than said load capacity. Alternatively the lighter rig may be used to reduce costs. The casing scheme of the invention allows to reduce the total weight of steel, by using multiple layers of pipe to jointly provide sufficient strength to withstand the wellbore pressures. By expansion of a second combined casing string (for instance a liner) against the inner surface of a first combined casing string, a liner hanger may be obviated.

Numerous modifications of the above described embodiments are conceivable within the scope of the attached claims. Features of respective embodiments may for instance be combined.

The invention claimed is:

1. A casing scheme for a wellbore, comprising:

a first casing string;

a second casing string nested within the first casing string and extending from a wellhead to a first downhole location;

a third casing string nested within the second casing string and extending from a second downhole location to a third downhole location, and overlapping the second casing string at an overlap section, wherein the second casing string is a first combined casing string, comprising at least a first first casing string layer fitting within and engaging an inner surface of a first second casing string layer, and wherein the third casing string is a second combined casing string comprising at least a second first casing string layer fitting within and engaging an inner surface of a second second casing string layer.

2. The casing scheme of claim 1, wherein each casing string layer is a closed tubular element.

3. The casing scheme of claim 2, wherein the closed tubular element has a continuous cylindrical wall lacking openings and being fluid-tight.

4. The casing scheme of claim 1, further comprising at least a tubular conductor; wherein the first casing string comprises a surface casing string which is arranged within the conductor with an annular space therebetween; and wherein a production casing string is arranged within the surface casing string, the production casing string being the first combined casing string.

5. The casing scheme of claim 1, wherein the third casing string is expanded against and engages an inner surface of the second casing string in the overlap section.

6. A casing scheme for a wellbore, comprising:

a first casing string;

a second casing string nested within the first casing string;

wherein at least one of the first casing string and the second casing string is a combined casing string, comprising at least a first casing string layer fitting within and engaging an inner surface of a second casing string layer, wherein a gap is present between the first casing string layer and the second casing string layer, which gap is smaller than a critical gap size.

7. The casing scheme of claim 6, wherein the critical gap size (CGS) is calculated from the formula:

$$CGS = \frac{r_i}{E}\left(\frac{-2P_c r_o^2}{r_o^2 - r_i^2}\right)$$

wherein $r_i$ is the inner diameter of the second, outer casing string layer, E is Young's modulus, $r_o$ is the outer diameter of the second casing string layer, and $P_c$ is the collapse pressure of the second casing string layer.

8. A casing scheme for a wellbore, comprising:

a first casing string;

a second casing string nested within the first casing string;

wherein at least one of the first casing string and the second casing string is a combined casing string, comprising at least a first casing string layer fitting within and engaging an inner surface of a second casing string layer, wherein the first casing string layer extends along substantially the entire length of the second casing string layer.

9. A casing scheme for a wellbore, comprising:

a first casing string;

a second casing string nested within the first casing string;

wherein at least one of the first casing string and the second casing string is a combined casing string, comprising at least a first casing string layer fitting within and engaging an inner surface of a second casing string layer, wherein the combined casing string extends from a wellhead of the wellbore to a downhole location.

10. The casing scheme of claim 1, wherein the combined casing string extends along at least 50%, or preferably 80%, of a total depth of the wellbore.

11. A wellbore, provided with a casing scheme comprising:

a first casing string;

a second casing string nested within the first casing string and extending from a wellhead to a first downhole location;

a third casing string nested within the second casing string extending from a second downhole location to a third downhole location, and overlapping the second casing string at an overlap section;

wherein the second casing string is a first combined casing string, comprising at least a first first casing string layer fitting within and engaging an inner surface of a first second casing string layer, and wherein the third casing string is a second combined casing string comprising at least a second first casing string layer fitting within and engaging an inner surface of a second second casing string layer.

12. A method for casing a wellbore, comprising the steps of:

providing a first casing string in the wellbore;

providing a second casing string nested within the first casing string;

wherein at least one of the first casing string and the second casing string is a first combined casing string, comprising at least a first casing string layer fitting within and engaging the inner surface of a second casing string layer, and extending from a wellhead to a first downhole location; and further comprising the step of:

arranging a second combined casing string nested within the combined casing string and extending from a second downhole location to a third downhole location.

13. A method for casing a wellbore, comprising the steps of:

providing a first casing string in the wellbore;

providing a second casing string nested within the first casing string;

wherein at least one of the first casing string and the second casing string is a combined casing string, comprising at least a first casing string layer fitting within and engaging the inner surface of a second casing string layer, wherein a gap is provided between the first casing string layer and the second casing string layer, which gap is smaller than a critical gap size.

$$CGS = \frac{r_i}{E}\left(\frac{-2P_c r_o^2}{r_o^2 - r_i^2}\right)$$

14. The method of claim 13, wherein the critical gap size (CGS) is calculated from the formula:

$$CGS = \frac{r_i}{E}\left(\frac{-2P_c r_o^2}{r_o^2 - r_i^2}\right)$$

wherein $r_i$ is the inner diameter of the second, outer casing string layer, E is Young's modulus, $r_o$ is the outer diameter of the second casing string layer, and $P_c$ is the collapse pressure of the second casing string layer.

15. A method of drilling and casing a wellbore using a drilling rig having a predetermined load capacity, comprising the step of:

using a casing scheme, comprising:

a first casing string;

a second casing string nested within the first casing string;

wherein at least one of the first casing string and the second casing string is a combined casing string, comprising at least a first casing string layer fitting within and engaging an inner surface of a second casing string layer, wherein the weight of the at least one combined casing string exceeds the load capacity of the drilling rig, and wherein the weight of each of the casing string layers of said combined casing string is less than the load capacity.

16. A method of drilling and casing a wellbore using a drilling rig having a predetermined load capacity, comprising the steps of:

providing a first casing string in the wellbore;

providing a second casing string nested within the first casing string;

wherein at least one of the first casing string and the second casing string is a combined casing string, comprising at least a first casing string layer fitting within and engaging the inner surface of a second casing string layer, wherein the weight of the at least one combined casing string exceeds the load capacity of the drilling rig, and wherein the weight of each of the casing string layers of said combined casing string is less than the load capacity.

17. A casing scheme for a wellbore, comprising at least:

a tubular conductor;

a first casing string comprising a surface casing string which is arranged within the conductor with an annular space therebetween;

a production casing string, which is arranged nested within the surface casing string, the production casing string being a combined casing string comprising at least a first casing string layer fitting within and engaging an inner surface of a second casing string layer.

18. A wellbore, provided with a casing scheme comprising:

a first casing string;

a second casing string nested within the first casing string;

wherein at least one of the first casing string and the second casing string is a combined casing string, comprising at least a first casing string layer fitting within and engaging an inner surface of a second casing string layer, wherein a gap is present between the first casing string layer and the second casing string layer, which gap is smaller than a critical gap size.

19. The wellbore of claim 18, wherein the critical gap size (CGS) is calculated from the formula:

$$CGS = \frac{r_i}{E}\left(\frac{-2P_c r_o^2}{r_o^2 - r_i^2}\right)$$

wherein $r_i$ is the inner diameter of the second, outer casing string layer, E is Young's modulus, $r_o$ is the outer diameter of the second casing string layer, and $P_c$ is the collapse pressure of the second casing string layer.

20. A wellbore, provided with a casing scheme comprising:

a first casing string;

a second casing string nested within the first casing string;

wherein at least one of the first casing string and the second casing string is a combined casing string, comprising at least a first casing string layer fitting within and engaging an inner surface of a second casing string layer, wherein the first casing string layer extends along substantially the entire length of the second casing string layer.

21. A wellbore, provided with a casing scheme comprising:

a first casing string;

a second casing string nested within the first casing string;

wherein at least one of the first casing string and the second casing string is a combined casing string, comprising at least a first casing string layer fitting within and engaging an inner surface of a second casing string layer, wherein the combined casing string extends from a wellhead of the wellbore to a downhole location.

22. A wellbore, provided with a casing scheme comprising:

a tubular conductor;

a first casing string comprising a surface casing string which is arranged within the conductor with an annular space therebetween;

a production casing string, which is arranged nested within the surface casing string, the production casing string being a combined casing string comprising at least a first casing string layer fitting within and engaging an inner surface of a second casing string layer.

* * * * *